US005386872A

United States Patent [19]

Chang

[11] Patent Number: 5,386,872

[45] Date of Patent: Feb. 7, 1995

[54] WASTED HEAT DRIVEN REFINERY'S PETROLEUM GAS RECOVERY APPARATUS

[76] Inventor: Wei-Min Chang, 3th Fl., No. 131, Alley 17, Lane 72, Kang-Leh St., Taipei, Taiwan, Prov. of China

[21] Appl. No.: 13,585

[22] Filed: Feb. 4, 1993

[51] Int. Cl.[6] ..... F25B 29/00

[52] U.S. Cl. ..... 165/47; 62/268; 62/270; 62/100; 196/138

[58] Field of Search ..... 165/47; 62/268, 270, 62/500, 100; 196/138

[56] References Cited

U.S. PATENT DOCUMENTS

| | | | |
|---|---|---|---|
| 2,129,097 | 9/1938 | Morgan | 62/270 |
| 2,158,869 | 5/1939 | Sperzel | 62/270 |
| 2,227,168 | 12/1940 | Wexler | 62/270 |
| 2,239,886 | 4/1941 | Feldbush et al. | 62/270 |
| 3,304,733 | 2/1967 | Coffman | 62/270 |
| 4,102,392 | 7/1978 | Schneider | 62/268 |

OTHER PUBLICATIONS

Villers R, "Water refrigerating machine" Sep. 1926, from Refrigerating Engineering p. 105.

*Primary Examiner*—John K. Ford

*Attorney, Agent, or Firm*—Pro-Techtor International

[57] ABSTRACT

A refinery petroleum gas recovery apparatus driven by normally wasted heat, comprising primarily the cooling system, the heat exchanging petroleum gas recovery system, and the appropriate peripheral equipment, wherein the wasted heat from the refining process is used as a power source for creating a vacuum cooling function to cool the water being heat exchanged with the petroleum gas down to the temperature of 12°-13° C. The heat in the gas is removed and the gas is condensed into liquid for reuse. The petroleum gases ethane, propane etc. which are ordinarily burned in the torch tower can now be recovered for reuse. The air pollution created from the burning of the gases in the torch tower is eliminated. Thus the apparatus has a high industrial value.

2 Claims, 2 Drawing Sheets

WASTED HEAT DRIVEN REFINERY'S PETROLEUM GAS RECOVERY APPARATUS

BACKGROUND OF THE INVENTION

The existing oil refineries mostly use the conventional "screw compressor" or "lithium bromide" cooling methods to effect the heat exchange for recovering petroleum gas. However, in those methods:

1. The screw compressor cooling method expends lots of energy, and the exhausting of electric power can not be compensated in cost by the recovered petroleum gas. Therefore refineries scarcely adapt this method except in the case when a prime factor is to protect the environment.

2. The lithium bromide cooling method of petroleum gas recovery also requires the exhausting of cooling media and absorbent (lithium bromide), yet it produces a relatively large volume of discharged heat. As such, it can be a heat contamination source notwithstanding the usage as a heat source of the wasted heat vapor.

Accordingly, most of the refineries in these days still take the torch tower burning method to burn the ethane, propane, butane, and other wasted petroleum gases which are hard to recover with the vapor fractionating tower. This method generates air pollution.

SUMMARY OF THE INVENTION

According to the above statements, the present invention provides a petroleum gas recovery apparatus based on principles and a system which are very different from those of the above stated conventional methods. It comprises primarily a water cooling system, a heat exchanging petroleum gas recovery system, and the appropriate peripheral auxiliary equipment (described later).

The hot vapor produced in the petroleum refining process of the refinery is not discharged but instead is received for being a leading fluid and is led into a series of ejectors. Its flow speed is increased to 1,000 m/sec when the fluid vapor passes through the ends of the throats of the ejectors and is subjected to a sudden gas expansion function. Meanwhile, there is a negative pressure approximating a vacuum state (about 10–15 torrs) created near the suction ends on the side faces of the ejectors. Water flowing through the evaporators (connected to the suction end of the ejectors) and subjected to the approximate vacuum state created by the leading fluid can have its latent heat removed so that the temperature of the water drops sharply to achieve the cooling effect.

The water with sharply reduced temperature is pumped through the heat exchanger to exchange heat with the ethane or propane gas flowing from the vapor fractionating tower instead of being in direct contact with the gas. the ethane or propane gas is condensed to a liquidized gas, and the liquid gas is pumped into a storage tank for use as a fuel for producing electricity or other uses.

Such a process can on one had recover the useful petroleum gas resources by using the usually wasted heat, and can on the other hand avoid sending the useful petroleum gas into the torch tower for burning so as to waste resources as well as creating air contamination. The present invention utilizing ejection cooling thus provides the following practical advantages over the conventional methods.

1. Using the normally wasted heat as an energy source, thereby reducing the consumption of electric power.

2. The primary cooling devices, except the pumps and cooling fans, are the ejectors, which are not moving parts. Thus there is little wear on the system, prolonging its useful life.

3. The cooling medium or absorbent is not needed at all, only the vapor is used as a cooling medium, so that the system is easy to manage.

4. The area occupied is small.

5. There is no need for any complex operation technique to smoothly operate the system.

BRIEF DESCRIPTION OF THE DRAWINGS

The system construction as well as the operation process of the present invention will be described in reference to the accompanying drawings, wherein:

Referring to FIG. 1, the present invention comprises primarily a water cooling system, heat exchanging petroleum gas recovery system, and peripheral auxiliary equipment, wherein:

Figure 1A:
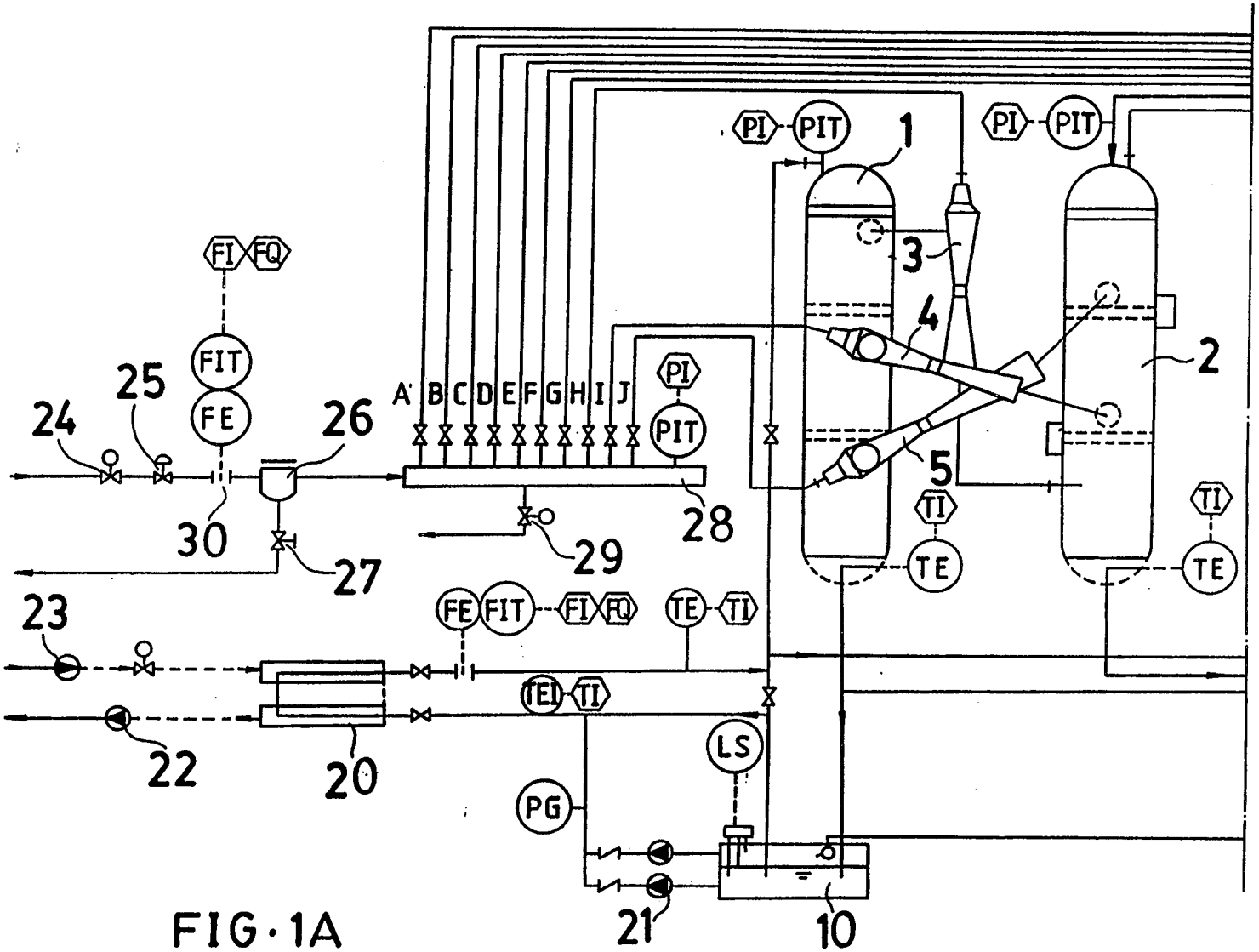
FIG. 1 is a schematic view of the system of the present invention.

The water cooling system comprises an evaporator 1, a main condenser 2, a first stage ejector 3, a second stage ejector 4, a third stage ejector 5, a first auxiliary ejector 6, a first auxiliary condenser 7, a second auxiliary ejector 8, and a second auxiliary condenser 9. The peripheral system thereof comprises a cooling water tank 10, a water supply tank 11, a cooling tower 12, a complementary water tank 13, a pressure filter tank 14, and a water storage tank 15. A water feeding pump 16 is provided between the water supply tank 11 and the cooling tower 12. (There is a standby feeding pump shown in the drawing.) A water feeding pump 17 (There is another standby feeding pump for the cooling tower 12 shown in the drawings.) for the cooling tower 12 is provided between the cooling tower 12 and the main condenser 2. An auto-back washing pump 18 for the pressure filter tank 14 is provided between the complementary water tank 13 and the pressure filter tank 14, while a complementary water feeding pump 19 is provided between the pressure filter tank 14 and the water storage tank 15. The cooling system can be enlarged according to the cooling energy required so as to have two or more sections which are all similar to the aforesaid cooling system (thus avoiding the individual elements having too large volume). For example, the embodiment shown in the drawing is a cooling system of two sections, i.e., besides the original system, there is an evaporator 1', a main condenser 2'. a fire stage ejector 3', a second stage ejector 4', a third stage ejector 5', a first auxiliary ejector 6', a first auxiliary condenser 7', a second auxiliary ejector 8', and a second auxiliary condenser 9' composing a second section of the cooling system. When enlarging the system by using multiple cooling sections, the volume of the peripheral units, i.e., the water tanks, filter tanks, pumps, etc. must also be enlarged to match the practical requirements.

The heat exchanging petroleum gas recovery system comprises a heat exchanger 20, a pressure pump 21 provided between the heat exchanger 20 and the cooling water tank 10 (there is another standby pump in the drawings), a liquid petroleum gas transporting pump 22 provided between the heat exchanger 20 and a storage tank (not shown), and a whirlwind type fan 23 for petroleum gas connected to the heat exchanger 20.

The peripheral auxiliary equipment comprises an explosion proof motor/membrane operated valve 24 fed from a vapor source, a self-controlled pressure maintenance valve 25 following the explosion proof motor/-membrane operated valve 24, a steam/water separator 26 following the self-controlled pressure maintenance valve 25, a drain valve 27 following the steam/water separator 26, a steam manifold cylinder 28 following the steam/water separator 26 with its multiple valves connected to the aforesaid cooling system, and a safety valve 29 for the steam manifold cylinder 28.

The control of the whole system (by the control and alarm units), of the present invention is initialed by keying in the working temperatures, pressures, volumes of flows, levels of liquids, etc. of all the unit components in a preset condition to the PLC central processing unit (CPU). All the liquid levels, flow volumes, pressures and temperatures of the fluids of the working units measured by the sensors are then converted into the electronic signals within 4–20 mA or 0–5 V, and input into the CPU of the PLC. If the working states of the working unit components show abnormalities not within the preset values, the CPU will emit a signal for warning or will stop the process automatically in case of emergency.

The control of the whole system relies on the main supervisory control units. There are other traditional mechanical instruments for the operator to observe when the PLC system is not functioning and the components of the units also happen to be not functioning. Such an arrangement can also be helpful for the field equipment checking and repairing.

Figure 1B:
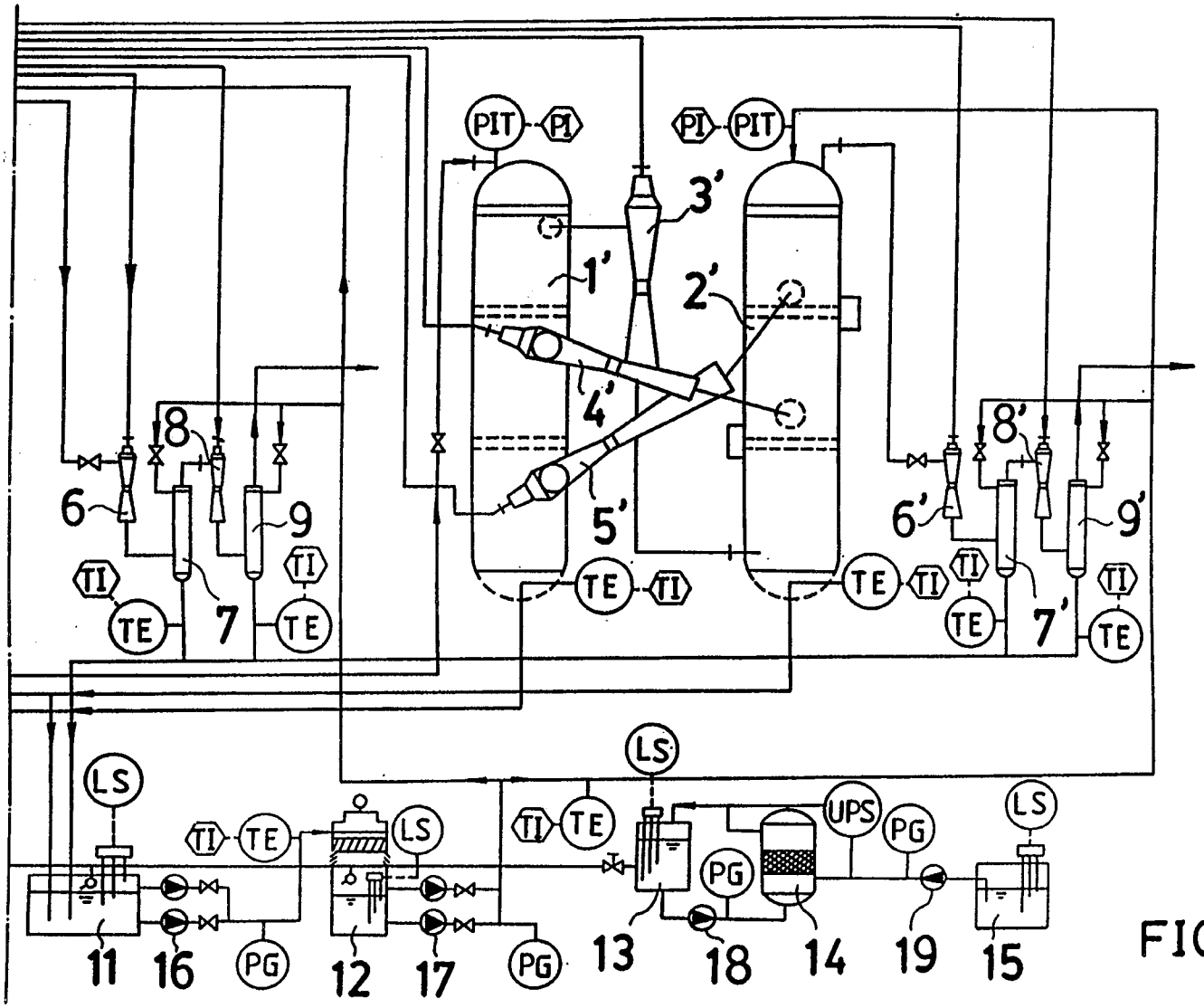

The circular symbols shown in FIG. 1 indicate the instruments installed in the field, while the hexagonal symbols indicate the electronic detectors for detecting the signals input to PLC control system. The english letters noted in the instruments indicate the functions of the instruments. The meaning of the symbols are as follows:

1. The initial F: means volume of flow detecting sensor or flowmeter.
2. The initial T: means temperature detecting sensor or thermometer.
3. The initial L: means liquid level detector.
4. The initial P (or DP): means pressure detecting sensor.

The operation process of the present invention includes the cooling process, the petroleum gas recovery process, and the complementary process. All the three processes are described as follows:

1. The cooling process:

(1) The water in the water supply tank 11 is fed through the water feeding pump 16 to the cooling tower 12, then flows through the water spreading nozzles and the spreading plates to the bottom of the cooling tower 12. The cooling fan on the top of the tower is activated to lower the temperature in the cooling tower 12 by means of auxiliary air cooling.

(2) The cooling water in the cooling tower 12 is fed through the water feeding pump 17 of the cooling tower 12 to the main condensers 2 and 2' and to flow through the nozzles on the top of the condensers 2, 2''. The water is then sprayed to the bottom of the condenser 2, 2', for condensing the high pressure steams ejected from the ends of the first, second, and third stage ejectors 3 (3'), 4 (4'), and 5 (5'), so that the working steams are condensed into water to flow back to the water supply tank 11.

(3) After normal operation of the above mentioned processes, the explosion proof motor/membrane operated valve 24 is activated, thus letting in the refinery vapor source with a pressure of 2–7 bars. The vapor pressure is stabilized by the self-controlled pressure maintenance valve 25. The vapor then flows through the steam flowmeter 30 for measuring the volume of the flow, and then through the steam/water separator 26. The liquid further flows through a drain valve 27 to discharge into a collecting pool, while the steam in the gas phase is led into a steam manifold cylinder 28, and then flows through the valves A–J which have been opened to come into the system operation.

(4) The steam coming into the system operation from the steam manifold cylinder 28 is divided into 2 segments, i.e., steam from valves A–E as one group, and F–J as another group. If only one group is needed for the system operation, then only the group A–E is used. As shown in the drawing, the steam from the valve J is led into the third stage ejector 5, the steam from the valve I is led into the second stage ejector 4, the steam from the valve H is led into the first stage ejector 3, while the steam from the valve G is led into the fist auxiliary ejector 6, and the steam from the valve F is led into the second auxiliary ejector 8. The distribution of the other group of steams which flows from the other valves is as follows:

Valve E→third stage ejector 5'
Valve D→second stage ejector 4'
Valve C→first stage ejector 3'
Valve B→first auxiliary ejector 6'
Valve A→second auxiliary ejector 8'

(5) In the ejecting operation, the main ejectors 3. 3' are connected at their flanks to one end of the evaporator 1 (1') to form an approximate vacuum state. Thus the latent heat in the water flow of the evaporator 1 (1') will be removed, and the water temperature in the cooling water tank 10 will be decreased rapidly when it flows through the evaporator 1 (1'). This is the cooling step. The function of the first auxiliary ejector 6 (6') to the main condenser 2(2') is similar to that of the first stage ejector 3 (3') to the evaporator 1 (1'). It is used to remove the latent heat in the water flow within the main condenser 2 (2') i.e., in this process, the function of the main condenser 2(2') is similar to that of the evaporator 1 (1'). Although it is used primarily to condense the vapor, it can also have the function of an evaporator.

(6) The process described above in sections (1)–(5) is the cooling process.

2. The petroleum gas recovery process:

(1) At the beginning of the petroleum gas recovery process, water is supplied from the pressure pump 21 to the heat exchanging pipes of the heat exchanger 20. The water then flows through the nozzle of the evaporator 1 (1') to be sprayed out and flows through the bottom of the evaporator 1 (1') to be sprayed out and flows through the bottom of the evaporator 1 (1') back to the cooling water tank 10. The water temperature during this process fluctuates about 8° C., i.e., the temperature is reduced from 20° C. to 12° C.±1° C.

(2) The whirlwind type fan 23 for the petroleum gas blows the petroleum gases ethane, propane, etc. into the heat exchanger 20 to effect the heat exchanging with the cooling water flow. The petroleum gases are condensed into liquids which is pumped by transporting pump 22 into a storage tank.

3. The complementary process:

The complementary process is for complementing the cooling tower 12, the water supply tank 11 and the cooling water tank 10 when the water flow therein is evaporated or otherwise lost. Thus the complementary system can complement and stabilize the water level of those components. the complementary process is as follows:

(1) The water in the water storage tank 15 is supplied from the water. To avoid contamination of the water tanks by the impurities contained in the tap water, the complementary water is fed into the pressure filter tank 14 by the complementary process to remove the impurities. The water is then fed into the complementary water tank 13. When the material for the pressure filter tank 14 becomes dirty after use. it can be back-washed with clean water from the complementary water tank 13 by the auto-back washing pump 18 for the pressure filter tank 14.

(2) The floating ball valves in all the water tanks will be activated to let in the complementary water when the water level in the cooling tower 12, water supply tank 11 or the cooling water tank 10 is lowered. When the water level rises to the upper limit, the ball valves will be closed automatically to cease operation of the complementary system.

According to the above statement, the present invention improves upon the ejection cooling method by using the novel systematic arrangement in a petroleum refinery to recover the petroleum gas which would ordinarily be burned and discarded. This on one hand can get rid of the public nuisance of air pollution created by the petroleum gas burning in a torch tower. The benefits of the present invention are thus outstanding and manifest. Furthermore, the present system uses the heat vapor produced by the refinery itself as a power source (the vapor ordinarily being discarded), and recovers the petroleum gas through the cooling effect created during the operation of the system. The system is therefore practical and economical for industry.

I claim:

1. A refinery petroleum gas recovery apparatus driven by normally wasted heat, comprising:

a water cooling system comprising an evaporator, a main condenser, a first stage ejector, a second stage ejector, a third stage ejector, a first auxiliary ejector, a first auxiliary condenser, a second auxiliary ejector, and a second auxiliary condenser; the water cooling system further including a peripheral system comprising a cooling water tank, a water supply tank, a cooling tower, a complementary water tank, a pressure filter tank, and a water storage tank; and further including a water feeding pump provided between the water supply tank and the cooling tower, a water feeding pump for the cooling tower provided between the cooling tower and the main condenser, an auto-back washing pump for the pressure filter tank provided between the complementary water tank and the pressure filter tank, and a complementary water feeding pump provided between the pressure filter tank and the water storage tank; wherein water in the water supply tank is fed through the water feeding pump to the cooling tower, then flows through water spreading nozzles and spreading plates to the bottom of the cooling tower, a cooling fan on the top of the tower is activated to lower the temperature in the cooling tower by means of auxiliary air cooling, the cooling water in the cooling tower is fed through the water feeding pump of the cooling tower to the condensers and to flow through nozzles on the top of the condensers, the water is then sprayed to the bottom of the condenser in order to condense high pressure steams ejected from the ends of the first, second, and third stage ejectors so that the steam is condensed into water to flow back to the water supply tank;

a heat exchanging petroleum gas recovery system comprising a heat exchanger, a pressure pump provided between the heat exchanger and the cooling water tank, a liquid petroleum gas transporting pump provided between the heat exchanger and a storage tank, and a whirlwind type fan for petroleum gas connected to the heat exchanger;

peripheral auxiliary equipment including an explosion proof motor/membrane operated valve fed from a vapor source, a self-controlled pressure maintenance valve in line with the explosion proof motor/membrane operated valve, a steam/water separator in line with the self-controlled pressure maintenance valve, a drain valve in line with the steam/water separator, a steam manifold cylinder in line with the steam/water separator with multiple valves of the steam manifold cylinder connected to the cooling system, the steam manifold cylinder including a safety valve.

2. The recovery apparatus as claimed in claim 1 wherein:

multiple units of said water cooling system comprising evaporator, main condenser, first stage ejector, second stage ejector, third stage ejector, first auxiliary ejector, first auxiliary condenser, second auxiliary ejector and second auxiliary condenser are utilized to expand the capacity of the system, the number of units being utilized being dependent on the energy requirements of the system.

* * * * *